US006109371A

United States Patent [19]

Kinnan

[11] Patent Number: 6,109,371

[45] Date of Patent: Aug. 29, 2000

[54] METHOD AND APPARATUS FOR STEERING AN EARTH BORING TOOL

[75] Inventor: Keith A. Kinnan, Camas Valley, Oreg.

[73] Assignee: The Charles Machine Works, Inc., Perry, Okla.

[21] Appl. No.: 09/021,583

[22] Filed: Feb. 10, 1998

Related U.S. Application Data

[60] Provisional application No. 60/047,525, Mar. 23, 1997.

[51] Int. Cl.[7] ..... E21B 7/00

[52] U.S. Cl. ..... 175/61; 175/73

[58] Field of Search ..... 175/45, 61, 73, 175/331, 356, 371

[56] References Cited

U.S. PATENT DOCUMENTS

| | | | |
|---|---|---|---|
| 4,360,069 | 11/1982 | Davis | 175/393 |
| 4,417,629 | 11/1983 | Wallace | 175/356 |
| 4,429,755 | 2/1984 | Williamson | 175/329 |
| 4,667,751 | 5/1987 | Geczy et al. | 175/61 |
| 4,733,735 | 3/1988 | Barr et al. | 175/393 |
| 4,739,842 | 4/1988 | Kruger et al. | 175/61 |
| 4,807,708 | 2/1989 | Forrest et al. | 175/45 |
| 4,953,638 | 9/1990 | Dunn | 175/61 |
| 5,099,931 | 3/1992 | Krueger et al. | 175/75 |
| 5,392,868 | 2/1995 | Deken et al. | 175/62 |
| 5,449,046 | 9/1995 | Kinnan | 175/24 |
| 5,513,713 | 5/1996 | Groves | 175/73 |
| 5,644,956 | 7/1997 | Blackman et al. | 175/371 |
| 5,755,297 | 5/1998 | Young et al. | 175/331 |
| 5,778,991 | 7/1998 | Runquist et al. | 175/61 |
| 5,941,322 | 8/1999 | Stephenson et al. | 175/62 |

*Primary Examiner*—William Neuder
*Attorney, Agent, or Firm*—McKinney & Stringer, P.C.

[57] ABSTRACT

A method for steering a drill bit are disclosed that allow steered horizontal drilling to be performed in rocky, semi-hard, or hard soils and rock, including the steps of stopping the advancement and rotation of the drill string, positioning the upper cutting portion so that the upper cutting portion is pointed in the direction it is desired to deflect the drill string, rocking the drill bit in an arc, thrusting the drill string forward while rocking, and rotating the drill bit.

25 Claims, 2 Drawing Sheets

METHOD AND APPARATUS FOR STEERING AN EARTH BORING TOOL

CROSS-REFERENCE TO RELATED APPLICATIONS

This application claims the benefit of the filing date of U.S. Provisional Application Ser. No. 60/047,525, entitled "METHOD AND APPARATUS FOR STEERING AN EARTH BORING TOOL," which was filed Mar. 23, 1997.

FIELD OF THE INVENTION

This invention relates generally to earth boring methods and equipment and, more particularly, to steerable drill bits and methods for steering the drill bit.

DESCRIPTION OF RELATED ART

The use of trenchless technology has become the preferred method for installing underground utilities in areas that already have surface development, highways, roads, waterways, rivers, or streams. Horizontal, directional drilling is one of the trenchless techniques employed to connect two trenches. Often, underground utilities are laid in trenches alongside a road. At an intersection (cross street), horizontal drilling is utilized to drill under this street. Thus, underground utilities can be installed without interfering with traffic or incurring the expense of road repair. Similarly horizontal drilling can be used to drill under other surface development so that utilities may be installed without disturbing this surface development.

Initially, horizontal drilling equipment was unable to control the direction of the drill head or bit. However, methods and drill heads or bits have been developed to steer the drill head. One of the first steering methods developed was disclosed in U.S. Pat. No. 4,953,638 (Dunn). Dunn uses a wedge shaped drill bit (Dunn,FIG. 6, #58). When a change in direction is desired, the rotation of the drill string and attached drill bit is stopped. The drill string is then rotated until the drill bit is angled in the desired direction. Next, the drill string and bit are pushed into the earth for a distance until the desired direction change is achieved. After resuming drill string rotation, the drill string and bit will now travel in a new direction. By repeating this process, the drill string may be controlled to follow a curved path. This system, however, can only be used in relatively soft soils.

The wedge shaped drill bit was improved in U.S. Pat. No. 5,392,868 (Deken). Deken discloses a large variety of wedge shaped drill bits that were not disclosed in Dunn. These new drill bits are shown in FIGS. 10–71 of Deken. FIGS. 66–68 illustrate a wedge shaped bit using two roller cones that have been cut from a standard oil field tri-cone bit. FIG. 71 shows a wedge shaped bit using a single roller cone cut from a standard oil field tri-cone bit. The drill heads disclosed in Deken are used in the same fashion as the wedge shaped bit in Dunn. The rotation of the drill string is stopped. The generally wedge shaped drill bit is aligned so that the deflecting surface is inclined at an angle relative to the axis of the drill string towards the new direction of the bore hole desired. The drill string is axially advanced without rotation. The reaction of the deflecting surface against the earth in front of the drill head causes the drill bit to move in the desired direction. The new drill bits disclosed permit this steering method to be used in some semi-hard soils.

In an attempt to overcome the limitations of the wedge drill bit system described above, an impulse steering system was developed. U.S. Pat. No. 5,449,046 (Kinnan) illustrates this system. This steering system uses a complex control system coupled with a complex drill bit to control the path of the drill string. The impulse steering system deflects the drill bit from the center of the bore hole (shown in FIGS. 3 and 4 of Kinnan) while the drill bit is rotating. However, the drill bit is deflected for only a short period of time on each rotation. Consequently, over many rotations the direction of the drill bit and attached drill string is altered.

While providing a system that will operate in hard soils or rock, the impulse steering systems discussed above employs complex devices that are relatively expensive to manufacture. Additionally, these devices, due to their complexity, are also expected to fail more often under field conditions. Therefore, there is a need for a simple, rugged, steerable, horizontal drilling system that can overcome the disadvantages of these current systems.

SUMMARY OF THE INVENTION

The present invention is directed to a method for steering a drill bit through a material which is to be cut so as to form a borehole, the drill bit defining an upper cutting portion. The method comprises the steps of a) positioning the drill bit so that the upper cutting portion of the drill bit points in a direction towards which an operator desires to steer the drill bit; b) rocking the drill bit through an arc; and c) thrusting the drill bit against an end of the borehole while rocking the drill bit so that the drill bit is advanced in the desired direction.

The present invention is further directed to a method for steering a drill bit through a material which is to be cut so as to form a borehole, the method comprising the steps of a) positioning the drill bit so that when the drill bit is rocked, the drill bit changes course in a desired direction; b) rocking the drill bit through an arc of between about 30 degrees and about 180 degrees; c) thrusting the drill bit forward while rocking the drill bit, the thrusting continuing until the drill bit advances at least approximately one inch; and d) periodically rotating the drill bit through at least approximately 180 degrees to clear the borehole.

The present invention is further directed to a drill bit comprising a) a body having an upper surface and a first end and a second end wherein the first end of the body is adapted to permit the drill bit to be connected to a drill string or drill head; and b) a roller cutting element supported at the second end of the body, the roller cutting element defining an upper cutting portion offset with respect to the upper surface of the body.

The present invention is further directed to a method of making an underground bore using a boring machine capable of axially advancing and rotating a drill string about an axis of rotation underground, the drill string having a first end operatively connectable to the boring machine and a second end terminating in a drill bit, the drill bit defining a body and an upper cutting portion offset with respect to the body, the method comprising the steps of a) rotating the drill bit to bore a generally straight borehole; b) stopping rotation of the drill bit; c) positioning the upper cutting portion of the drill bit in a direction towards which an operator desires to steer; d) rocking the drill bit through an arc; e) thrusting the drill bit against an end of the bore while rocking the drill bit through the arc, whereby the drill bit is advanced in the desired direction; and f) periodically rotating the drill bit at least one fill rotation to clear the bore.

Finally, the present invention is directed to a boring machine for creating underground boreholes, the boring machine capable of axially advancing and rotating a drill string about an axis of rotation underground, the drill string having a first end operatively connectable to the boring machine and a second end terminating in a drill bit, the drill bit comprising a body having an upper surface and a first end and a second end wherein the first end the body is adapted to permit the drill bit to be connected to the drill string; and a roller cutting element supported at the second end of the body, the roller cutting element defining an upper cutting portion offset with respect to the upper surface of the body.

DESCRIPTION OF THE PREFERRED EMBODIMENT

Equipment

Figure 1:
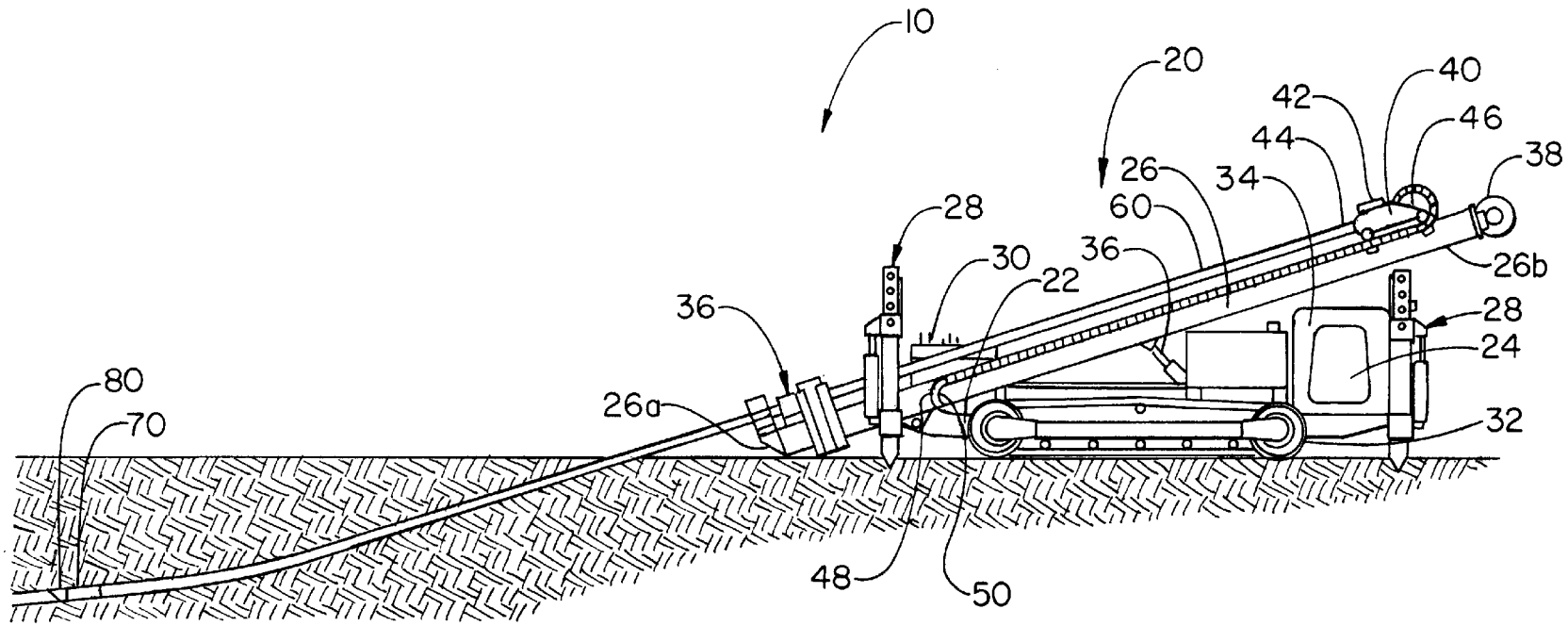
FIG. 1 is a side view of a drilling apparatus in accordance with the present invention.

FIG. 1 illustrates a steered horizontal drilling apparatus 10, in accordance with the present invention. The drilling apparatus 10 includes a conventional horizontal drill rig 20, drill string 60, and a drill head 70.

Horizontal drill rig 20 includes a chassis 22 which supports an engine 24, a main boom 26, a machine stake down system 28, and a control panel 30. The engine 24 provides power to a track carrier 32 and to a hydraulic pump 34. Once the drilling apparatus 10 is delivered to the work site, the track carrier 32 is used to position drill rig 20. After positioning the drill rig 20 at a work site, the machine stake down system 28 is deployed to stabilize and secure the drill rig 20. Hydraulic pump 34 provides high pressure hydraulic fluid to operate the hydraulic systems on the drill rig 20.

Main boom 26 pivots on chassis 22. The angle of main boom 26 is adjusted by means of hydraulic cylinder 36. Main boom 26 has a first end 26*a* that supports a drill rod break out clamp assembly 36 and a second end 26*b* that supports the carriage travel drive motor 38. Riding on the main boom 26 is a carriage 40. This carriage is positioned using the carriage travel drive motor 38. Fixed to carriage 40 is a drill string rotation motor 42. Rotation motor 42 is connected to drill string 60 with a drill rod spindle shaft 44. Rotation motor 42 is also flexibly coupled to main boom 26 with a flexible hose track 46. This hose track protects and carries hydraulic hoses 48 and mud hose 50. Hydraulic hoses 48 provide high pressure hydraulic fluid from hydraulic pump 34 via control panel 30. This high pressure fluid provides the energy to rotate, rock, or oscillate the drill string 60. Mud hose 50 provides drilling mud to the drill head 70 through the drill string 60 and drill rod spindle shaft 44.

Control panel 30 provides a central control station from which to operate the drilling apparatus 10. In addition to providing all the conventional hydraulic controls for the drill rig 20, there is a position or orientation indicator. This indicator shows the depth, horizontal angle pitch, and the tool face position or relative angle of drill bit 80 with respect to the longitudinal axis of the drill string 60. The position indicator receives this information from a sonde transmitter in drill head 70. This information is transmitted by either a radio link or hard wire to the position indicator. The preferable transmission method is by radio link, since the wire does not have to be spliced with the addition of each drill rod. However, if the length of the bore hole will exceed 1000 feet, then it is preferred to transmit the signal by wire.

Figure 2:
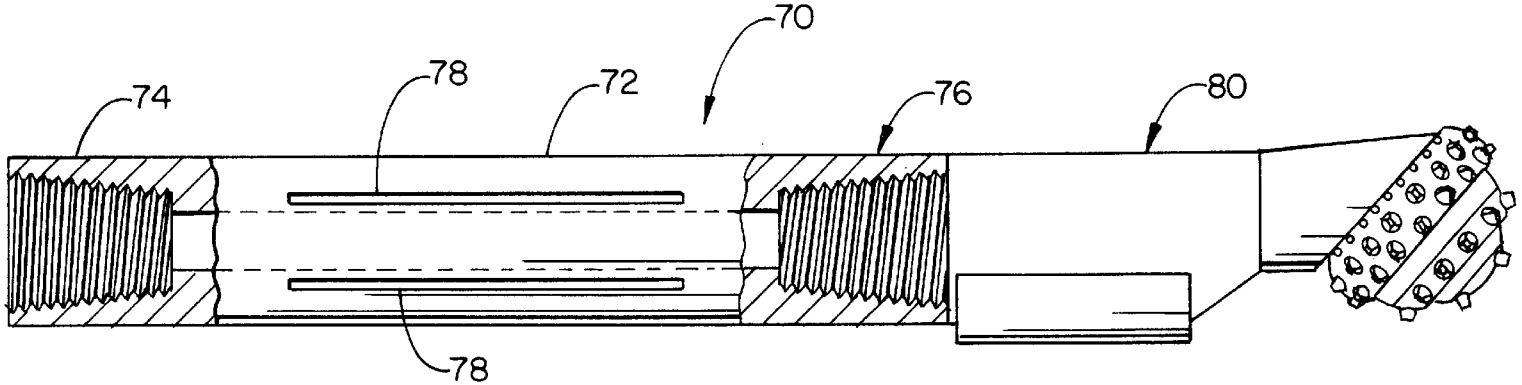
FIG. 2 is a cross section of a drill head used in the apparatus of FIG. 1.

With reference now to FIG. 2, this drawing illustrates drill head 70 in greater detail. Drill head 70 includes a sonde transmitter housing 72 and a drill bit 80. The sonde transmitter housing 72 has a drill string end 74 and a drill bit end 76. Ends 74 and 76 provide standard connectors used in the drilling industry to connect drill string end 74 to the drill string 60 and drill bit end 76 to the drill bit 80. Inside the transmitter housing 72 resides a sonde transmitter 78. The sonde transmitter 78 enables an operator on the surface with a receiver to locate the drill head 70. Additionally, the sonde transmitter 78 in combination with the receiver provides the operator with the depth, rotation angle (tool face position), and horizontal angle of the drill head 70. The use of a transmitter housing 72 and sonde transmitter 78 are current practice in the horizontal drilling industry.

Figure 3:
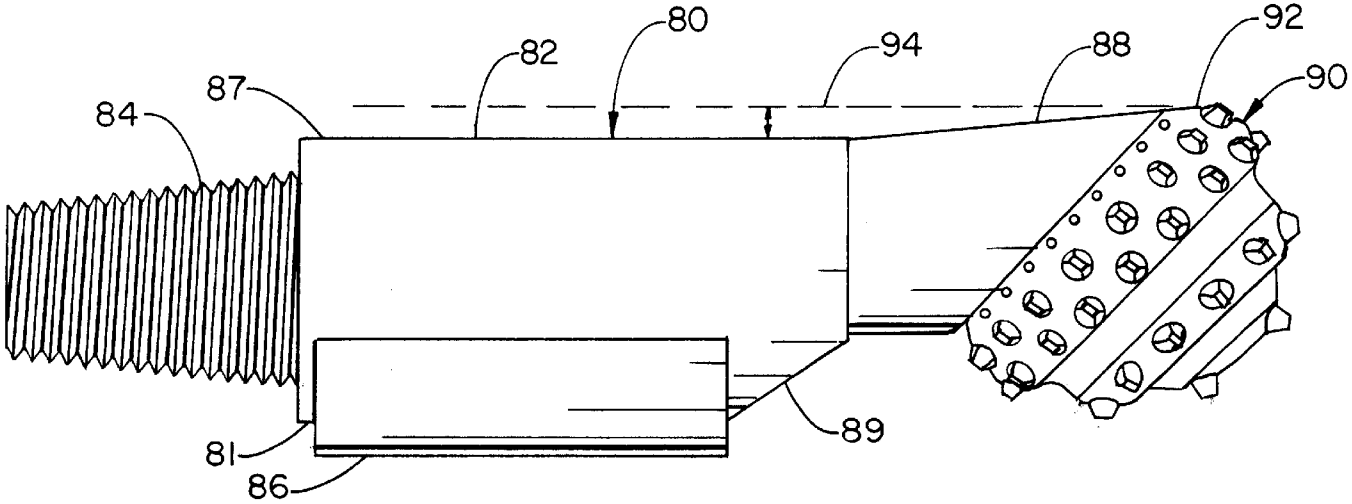
FIG. 3 is a side view of the drill bit shown in FIG. 2.

FIG. 3 provides a detailed illustration of drill bit 80. This drill bit has a cylindrical body 82, a connector 84, a wear plate 86, a roller cone arm 88, a drill mud port 89, and a single roller cone bit 90. The cylindrical body 82 is generally a hollow steel cylinder having an industry standard connector 84 at a first end. Cylindrical body 82 will be preferably made from steel, however, any material which is sufficiently strong and durable for use in drilling applications is acceptable. Cylindrical body 82 may be of any shape, however, the preferred shape would be generally cylindrical. A cylindrical shape tends to minimize the force required to rotate the drill bit 80.

While not required for drilling operations, it is preferred that the wear plate 86 be fastened to the lower surface 81 of cylindrical body 82. Wear plate 86 is designed to increase the working life of the drill bit 80. Preferably, wear plate 86 will be fastened to the cylindrical body 82 with threaded fasteners which will allow the wear plate 86 to be easily replaced. In some applications, where there is a large coefficient of friction between the bore hole and the drill bit 80, it may be desirable to weld wear plate 86 to the cylindrical body 82. The welding of wear plate 86 to cylindrical body 82 will reduce the chance that wear plate 86 would become detached from the cylindrical body 82 due to a fastener failure. Alternatively, a rough, but usable wear plate may be fashioned by a weld build up on a lower side of cylindrical body 82 in the location shown by wear plate 86. This wear plate 62 using a weld build up has the advantage of easy field repair since it would be easy to build up the weld material after the wear plate 86 wore down. Typically, wear plate 86 will be formed from a hardened tool steel, however, other materials may be used which will be durable enough to provide a reasonable service life.

Fastened to the second end of cylindrical body 82 is roller cone arm 88. For the drill bit 80 to cut the best in hard soils, rocky soils, or in rock, the roller cone arm 88 should be attached to the cylindrical body 82 so that the roller cone 90 will use a similar cutting action and present a similar cutting face as a roller cone used in a tri-cone bit. Preferably, an upper cutting portion 92 of roller cone 90 will be offset from the upper edge, or surface, 87 of cylindrical body 82, as illustrated by reference line 94 in FIG. 3. For the best all around drilling, this offset will be between about ⅛ and about ¼ inches. A larger offset will provide for faster course changes. However, using a larger offset will increase the drilling time since a large diameter bore is cut. Additionally, use of a larger offset reduces the directional stability of the drill bit 80. Thus, the operator must select the drill bit offset based on the maneuverability desired contrasted with the additional time required to drill the bore hole.

Preferably, cylindrical body 82 will be welded to roller cone arm 88. However, a pinned interference joint, a pinned splined joint, or pinned threaded joint would function adequately, if the pin or pins combined with the joint had sufficient shear strength to prevent the roller cone arm 88 from separating from the cylindrical body 82 during drilling operations. The use of this joint between cylindrical body 82 and roller cone arm 88 would allow easier replacement of the roller cone bit 90.

Attached to the distal end of the roller cone arm 88 is roller cone bit 90. Preferably, roller cone bit 90 is an industry standard roller cone, whose diameter is greater than the diameter of drill bit 80, drill head 70 or drill string 60 being used. A five inch roller cone has been found to be an excellent roller cone bit 90 for a four inch drill string 60. The use of a five inch roller cone provides sufficient over cutting to minimize the friction between drill string 60 and drill head 70, and the bore hole. Additionally, the use of a roller cone bit 90 that is the same size or larger than the diameter or width of the drill string 60, drill head 70, or cylindrical body 82 with attached wear plate 86, if used, reduces the wear on these components and reduces the likelihood of mud port 89 becoming blocked. A satisfactory roller cone arm 88 and roller cone bit 90 assembly may be made by cutting a single roller cone of proper diameter from a tri-cone bit used in underground drilling operations. For the best results, this cut should be made perpendicular to the longitudinal axis of the tri-cone bit. Preferably, roller cone bit 90 is attached to roller arm 88 using current industry standard practice. It is possible, however, for roller cone bit 90 to be removably attached to roller cone arm 88. For example, this removable attachment could use one of the following connections: a threaded joint, a threaded and pinned joint; a splined and pinned joint; or an interference fit and pinned joint. The use of the removable attachment would permit the roller cone bit 90 to be replaced without having to replace the entire drill bit 80. If one of the these connections is used, the connection must be able to withstand the forces of drilling operations without allowing the roller cone bit 90 to separate from the roller cone arm 88. The roller cone bit 90 has an upper cutting portion 92. This portion of the roller cone bit 90 cuts the outer diameter of the bore hole.

Below roller cone arm 88 on the second end of the cylindrical body 82 is the drill mud port 89. This port provides a passage for the drill mud to exit the drill head 70. The drill mud cools and lubricates the drill bit 80. Additionally, this drill mud helps to carry away drill cuttings. Preferably, drill mud port 89 is ⅜ inch to 2 inches in diameter. This port may be any convenient shape or size, as long as there is adequate area to allow the passage of sufficient drill mud to cool and lubricate the drill bit and to carry away the drill cuttings. Typically, the flow rate of drill mud from the port 89 is about 20 gallons per minute.

Operation

Initially, drill rig 20 is positioned, secured at the drill site, and a bore hole commenced according to current industry practice. A straight bore hole is produced by continuously rotating drill string 60 with rotation motor 42. The rotation of drill string 60 will cause a corresponding rotation of drill head 70 and drill bit 80. When the operator desires to alter the direction of the drill bit 80, drill head 70 and attached drill string 60, the following method is used.

Typically, but not required, the operator first stops the rotation of the rotation motor 42. The rotation motor 42 is then engaged to rotate the drill string 60 and drill head 70 until drill bit 80 is positioned with upper cutting portion 92 pointing in the direction the operator desires to divert the course of the drill bit 80, drill head 70 and drill string 60. Alternatively, the upper cutting portion 92 may be positioned such that when the drill string 60, drill head 70, and drill bit 80 are rocked or oscillated the course of these components will divert in the direction desired by the operator. The operator then rocks or oscillates, the drill string, 60, drill head 70, and drill bit 80 back and forth through an arc using rotation motor 42. Rocks means any angular motion about the drill string 60 rotation axis that causes an intentional course change, including, but not limited to, oscillation of the drill bit 80 with rotation motor 40 to approximately equal angles to either side of the desired course change direction. Typically, when drill bit 80 is rocked the course change direction is approximated by finding the average of the mid-arc angle for each clockwise or counterclockwise angular displacement. For example; assuming that 0 degrees is at the 12 o'clock position which points toward the surface, if upper cutting portion 92 starts at 0 degrees and is turned clockwise to 45 degrees, then counterclockwise to 315 degrees, and then clockwise back to 0 degrees, then average of the mid-arc angles would be [22.5+0+−22.5 (337.5°)]/3=0 degrees. Thus, the drill bit 80 will tend to change its direction of travel towards the surface. However, if the upper cutting portion 92 starts at 0 degrees and is turned clockwise to 180 degrees, then turned counterclockwise to 45 degrees, then clockwise to 135 degrees, and then counterclockwise back to 0 degrees, then the average of the mid-arc angles would be (90+112.5+90+67.5)/4=90 degrees. Thus, the drill bit 80 will tend to change its direction of travel towards the 3 o'clock position.

Typically, this arc is between about 30 degrees and about 180 degrees. Preferably, drill bit 80 and upper cutting portion 92 will travel back and forth through an arc or angle of approximately 90 degrees or approximately ±45 degrees from the desired direction of course change. A forward thrust similar to normal drilling operations is applied to the drill bit 80 while rocking the drill bit 80. This thrust is provided by carriage travel drive motor 38 acting on carriage 40 and through rotation motor 42 and drill rod spindle shaft 44, drill string 60, and drill head 70. This rocking with forward thrust is continued until the drill bit 80 has advanced some distance.

This distance of advance will vary depending on soil density. A shorter advance distance is used when drilling in harder soils. Typically, an advance distance of about 1 to about 4 inches is sufficient for rocky soils. Advance distances of one or more drill rods may be used in very soft soils. Therefore, the advance distance may be as small as approximately one (1) inch to as large as several drill rods, approximately 100 feet. After the drill bit 80 has advanced the proper distance, the drill string 60, drill head 70 and drill bit 80 are turned through approximately 180 degrees with rotation motor 42 to clear the bore hole. Preferably, the drill string 60, drill head 70 and drill bit 80 are rotated through at least one full rotation (360 degrees). Each time the bore is cleared there will be some loss of the course change achieved while rocking. Thus, the bore typically is cleared only when required due to the lack of forward progress while rocking the drill string 60, drill head 70 and drill bit 80. The bore may, however, be cleared as often as an operator desires. This process of positioning the drill bit 80, rocking the drill string 60, drill head 70 and drill bit 80 with forward thrust applied by the carriage travel drive motor 38, and clearing the bore hole is repeated until the desired course correction is achieved. After positioning the drill head 70 on the new course, the rotation motor 42, drill string 60, drill head 70, and drill bit 80 are continually rotated to advance the bore hole in a relatively straight line. This continuous rotation will be continued, until it is once again desired to alter the path of the drill bit 80, drill head 70 and attached drill string 60.

Having then described the present invention in its preferred embodiment, it should be understood that modification and adaptations may be resorted to without departing from the spirit there of. Accordingly, this invention is not to be limited except as by the appended claims.

What is claimed is:

1. A method for steering a drill bit through a material which is to be cut so as to form a borehole, the drill bit defining an upper cutting portion, and the method comprising the steps of:

a) positioning the drill bit so that the upper cutting portion of the drill bit points in a direction towards which an operator desires to steer the drill bit;

b) rocking the drill bit through an arc; and c) thrusting the drill bit against an end of the borehole while rocking the drill bit so that the drill bit is advanced in the desired direction.

2. The method of claim 1 further comprising d) the step of periodically rotating the drill bit at least one full rotation to clear the borehole.

3. The method of claim 2 wherein, prior to the step of periodically rotating the drill bit, the step of thrusting the drill bit is continued until the drill bit has advanced at least one inch.

4. The method of claim 3 wherein, prior to the step of periodically rotating the drill bit, the step of thrusting the drill bit is continued until the drill bit has advanced between about one and about four inches.

5. The method of claim 2 further comprising the steps of repeating steps a) through d) until the desired direction change is accomplished.

6. The method of claim 1 wherein the step of rocking the drill bit through an arc is carried out between about 30 degrees and about 180 degrees.

7. The method of claim 1 wherein the step of rocking the drill bit through an arc is carried out between about 70 degrees and about 110 degrees.

8. A method for steering a drill bit through a material which is to be cut so as to form a borehole, the method comprising the steps of:

a) positioning the drill bit so that when the drill bit is rocked, the drill bit changes course in a desired direction;

b) rocking the drill bit through an arc of between about 30 degrees and about 180 degrees;

c) thrusting the drill bit forward while rocking the drill bit, the thrusting continuing until the drill bit advances at least approximately one inch; and d) periodically rotating the drill bit through at least approximately 180 degrees to clear the borehole.

9. The method of claim 8 wherein the step of rocking the drill bit through an arc is carried out between about 70 degrees and about 110 degrees.

10. The method of claim 8 further comprising repeating steps a) through d) until the desired direction change is accomplished.

11. The method of claim 8 wherein the step of rocking the drill bit through an arc is carried out between about 45 degrees and about 135 degrees.

12. The method of claim 8 wherein, prior to the step of periodically rotating the drill bit, the step of thrusting the drill bit is continued until the drill bit has advanced at least one inch.

13. The method of claim 8 wherein, prior to the step of periodically rotating the drill bit, the step of thrusting the drill bit is continued until the drill bit has advanced from about one and to about four inches.

14. A drill bit comprising:

a body having an upper surface and a first end and a second end wherein the first end of the body is adapted to permit the drill bit to be connected to a drill string or drill head; and a single roller cutting element supported at the second end of the body, the roller cutting element defining an upper cutting portion offset with respect to the upper surface of the body;

wherein the offset is between approximately 0.0 and approximately 0.5 inches.

15. The drill bit of claim 14, wherein the offset is between approximately 0.125 and approximately 0.25 inches.

16. The drill bit of claim 14 wherein the diameter of roller cutting element is greater than the diameter of the body.

17. A method of making an underground bore using a boring machine capable of axially advancing and rotating a drill string about an axis of rotation underground, the drill string having a first end operatively connectable to the boring machine and a second end terminating in a drill bit, the drill bit defining a body and an upper cutting portion offset with respect to the body, the method comprising the steps of:

a) rotating the drill bit to bore a generally straight borehole;

b) stopping rotation of the drill bit;

c) positioning the upper cutting portion of the drill bit in a direction towards which an operator desires to steer;

d) rocking the drill bit through an arc;

e) thrusting the drill bit against an end of the bore while rocking the drill bit through the arc, whereby the drill bit is advanced in the desired direction; and f) periodically rotating the drill bit at least one full rotation to clear the bore.

18. The method of claim 17 further comprising repeating steps a) through f) until the desired direction change is accomplished.

19. The method of claim 18 wherein the step of rocking the drill bit through an arc is carried out between about 30 degrees and about 180 degrees.

20. The method of claim 18 wherein the step of rocking the drill bit through an arc is carried out between about 70 degrees and about 110 degrees.

21. The method of claim 18 wherein prior to the step of periodically rotating the drill bit, the step of thrusting the drill bit continues until the drill bit has advanced at least one inch.

22. The method of claim 18 wherein prior to the step of periodically rotating the drill bit, the step of thrusting the drill bit continues until the drill bit has advanced between about one and about four inches.

23. A boring machine for creating underground boreholes, the boring machine capable of axially advancing and rotating a drill string about an axis of rotation underground, the drill string having a first end operatively connectable to the boring machine and a second end terminating in a drill bit, the drill bit comprising:

a body having an upper surface and a first end and a second end wherein the first end of the body is adapted to permit the drill bit to be connected to the drill string; and a single roller cutting element supported at the second end of the body, the roller cutting element defining an upper cutting portion offset with respect to the upper surface of the body;

wherein the offset is between approximately 0.0 and approximately 0.5 inches.

24. The boring machine of claim 23, wherein the offset is between approximately 0.125 and approximately 0.25 inches.

25. The boring machine of claim 23, wherein the diameter of the roller cutting element is larger than the diameter of the body.

* * * * *